US008944511B2

(12) United States Patent
Wang

(10) Patent No.: US 8,944,511 B2
(45) Date of Patent: Feb. 3, 2015

(54) ARMREST ASSEMBLY

(71) Applicant: Chuan Hsing Chemical Industry Co., Ltd., Taichung (TW)

(72) Inventor: Ching-Chang Wang, Taichung (TW)

(73) Assignee: Chuan Hsing Chemical Industry Co., Ltd., Taichung (TW)

( * ) Notice: Subject to any disclaimer, the term of this patent is extended or adjusted under 35 U.S.C. 154(b) by 168 days.

(21) Appl. No.: 13/775,128

(22) Filed: Feb. 23, 2013

(65) Prior Publication Data

US 2014/0239696 A1 Aug. 28, 2014

(51) Int. Cl.
*A47C 7/54* (2006.01)

(52) U.S. Cl.
CPC ..... *A47C 7/546* (2013.01)
USPC ..... 297/411.23

(58) Field of Classification Search
USPC ..... 297/227, 411.2, 411.23; 16/342
See application file for complete search history.

(56) References Cited

U.S. PATENT DOCUMENTS 5,478,137 A * 12/1995 Olson et al. ..... 297/411.26
5,667,277 A * 9/1997 Van De Riet ..... 297/411.36
6,168,236 B1 * 1/2001 Chen ..... 297/411.2
6,511,131 B1 * 1/2003 Harnois ..... 297/411.23
6,572,194 B2 * 6/2003 True ..... 297/411.2
6,948,775 B2 * 9/2005 Tsai ..... 297/411.37
6,976,739 B2 * 12/2005 Wang ..... 297/411.35
2007/0007810 A1 * 1/2007 Wu ..... 297/411.37
2009/0189428 A1 * 7/2009 Fookes et al. ..... 297/344.18
2009/0302661 A1 * 12/2009 Melhuish et al. ..... 297/411.35
2010/0301656 A1 * 12/2010 Lai ..... 297/411.2
2011/0140497 A1 * 6/2011 Fookes et al. ..... 297/411.2
2012/0068512 A1 * 3/2012 Fookes et al. ..... 297/344.12
2012/0146381 A1 * 6/2012 Spooner et al. ..... 297/411.46
2013/0062899 A1 * 3/2013 Stoia ..... 296/24.34

* cited by examiner

*Primary Examiner* — David R Dunn
*Assistant Examiner* — Timothy J Brindley
(74) *Attorney, Agent, or Firm* — Alan D. Kamrath; Kamrath IP Lawfirm, P.A.

(57) ABSTRACT

An armrest assembly includes a base, an arm support, and a connector. The base includes a connecting portion and an installing portion formed at two opposite ends thereof. The installing portion is adapted for installing to a chair. A first surface at one end of the connecting portion is opposite to the installing portion. The arm support is supported on the base and includes a second surface faced to the first surface of the base. A cavity is defined in one of the first and second surfaces. An engaging member is formed on the other of the first and second surfaces and pivotably received in the cavity between an unlocked position and a locked position. A connector is received in the cavity of the arm support and engaged with the engaging member. The arm support is fixed to the base in the locked position.

10 Claims, 10 Drawing Sheets

ARMREST ASSEMBLY

BACKGROUND OF THE INVENTION

1. Field of the Invention

An armrest is shown with a base, an arm support, and a connector, and, in particular, an armrest is shown which can be assembled easily and quickly without fastening tools, such as screwdrivers.

2. Description of the Related Art

Various universal chair armrests usually comprise a base connected to an armrest support. One end of the armrest support is installed to a chair, and the base is formed on the other end of the armrest support. Although this design of the chair armrest reduces time to install the base to the armrest support, the manufacturing process of the chair armrest is very inconvenient. The mold of the chair armrest manufactured into a one-piece structure is difficult to bring about, thereby increasing manufacturing costs.

U.S. Pat. No. 6,168,236 discloses an armrest including a lower cover with a number of retainer rings and an upper cover mounted on top of the lower cover. A plurality of metal nut fasteners are mounted in the retainer rings, respectively. Each of the plurality of nut fasteners has a screw hole to allow the armrest to be mounted to a base by screws. A plurality of engaging plates is provided for securely engaging the upper cover with the lower cover. The plurality of metal nut fasteners can be removed by machinery, but it is inconvenient to remove the plurality of nut fasteners in the disassembly process.

Therefore, there is a need for an armrest that overcomes the above problems and that provides an inexpensive, secure attachment which does not require fasteners or precise tolerances. Further, an armrest is desired that allows for quick attachment without use of complex machinery. Still further, there is a need for an armrest that does not become loose over a period of time and also that provides an uncluttered, aesthetically pleasing appearance.

Therefore, a need exists for an armrest intended to obviate or at least alleviate the problems encountered in the prior art.

SUMMARY OF THE INVENTION

An armrest assembly includes a base, an arm support supported on the base, and a connector. The base includes a connecting portion and an installing portion formed at two opposite ends thereof. The installing portion is adapted for installing to a chair. A first surface at one end of the connecting portion is opposite to the installing portion. The arm support is supported on the base and includes a second surface faced to the first surface of the base. A cavity is defined in one of the first and second surfaces. An engaging member is formed on the other of the first and second surfaces and pivotably received in the cavity between an unlocked position and a locked position. A connector is received in the cavity of the arm support and engaged with the engaging member. The arm support is fixed to the base in the locked position.

The engaging member has an end face opposite to the first surface.

In a preferred form, the end face is extended parallel to the first surface.

The engaging member further includes a body portion, two first engaging portions radially extending oppositely from the body portion to a radial extent, and two second engaging portions longitudinally extending at two arc sections of the body portion between the two first engaging portions.

The arm support includes a second connecting portion and a supporting portion formed at two opposite ends thereof.

In particular, the supporting portion is made of a soft material and adapted for resting a user's arm.

The cavity includes two first receiving portions having a shape corresponding to and for longitudinally slideably receiving the two first engaging portions of the engaging member, and two second receiving portions interconnected with the two first receiving portions and having a shape corresponding to and for longitudinally slideably receiving the two arc sections of the body portion and pivotally receiving the two first engaging portions of the engaging member.

The connector is longitudinally slideably received in the cavity of the arm support and engageable with the two second engaging portion of the engaging member of the base.

The connector includes a top portion and two side portions extending from two opposite distal ends of the top portion and perpendicular to the top portion. The top portion has an abutted face abutted against the end face of the engaging member. Each of the two side portions has first and second coupled sections formed opposite to each other. Each of the two first coupled sections is engaged with each of the two first receiving sections of the cavity. Each of the two second coupled sections is engageable with the two second engaging portions of the engaging member.

In a preferred form, the cavity further includes two stopping portions each radially extended inward between each of the two first receiving portions and each of the two second receiving portions adapted for abutting against the two first engaging portions of the engaging member to restrict the arm support to pivot in relation to the base in a single pivoting direction.

The cavity further includes two restraining portions formed in an arc shape and radially extending inward from distal ends of the two second receiving portions adjacent to the second surface. The connector further includes two flanges extended outward from the two side portions thereof and abutted against the two restraining portions of the cavity to prevent the connector disengaged from the cavity of the arm support.

In a preferred form, the arm support is pivotable in relation to the base between an unlocked position and a locked position. When the arm support is in the unlocked position, the two side portions of the connector abut against the end face of the engaging member, with the two first engaging portions engaged in the two first receiving sections of the cavity to cause the connector longitudinally sliding with respect to the cavity and pressing against the supporting portion of the arm support. Thus, the supporting portion is deformed.

The engaging member is received in the cavity. Moreover, the arm support is pivoted 90 degrees counterclockwise about the base. Thus, the two first engaging portions is engaged in the second receiving sections of the cavity and abutted against the two stopping portions to cause the arm support unable to be pivoted in relation to the base.

Moreover, pressing the supporting portion of the arm support abuts against the connector to cause the connector longitudinally sliding with respect to the engaging member. The arm support is in the locked position, the two second coupled sections of the side portion of the connector are engaged with the two second engaging portions of the engaging member. Thus, the support is unable to longitudinally move and pivot with respect to the base. The arm support is securely fixed to the base.

It is an object of the present invention to provide an armrest can be assembled easily and quickly without fastening tools.

Other objectives, advantages, and novel features will become more apparent from the following detailed description when taken in conjunction with the accompanying drawings.

BRIEF DESCRIPTION OF THE DRAWINGS

The illustrative embodiment may best be described by reference to the accompanying drawings where.

Figure 1:
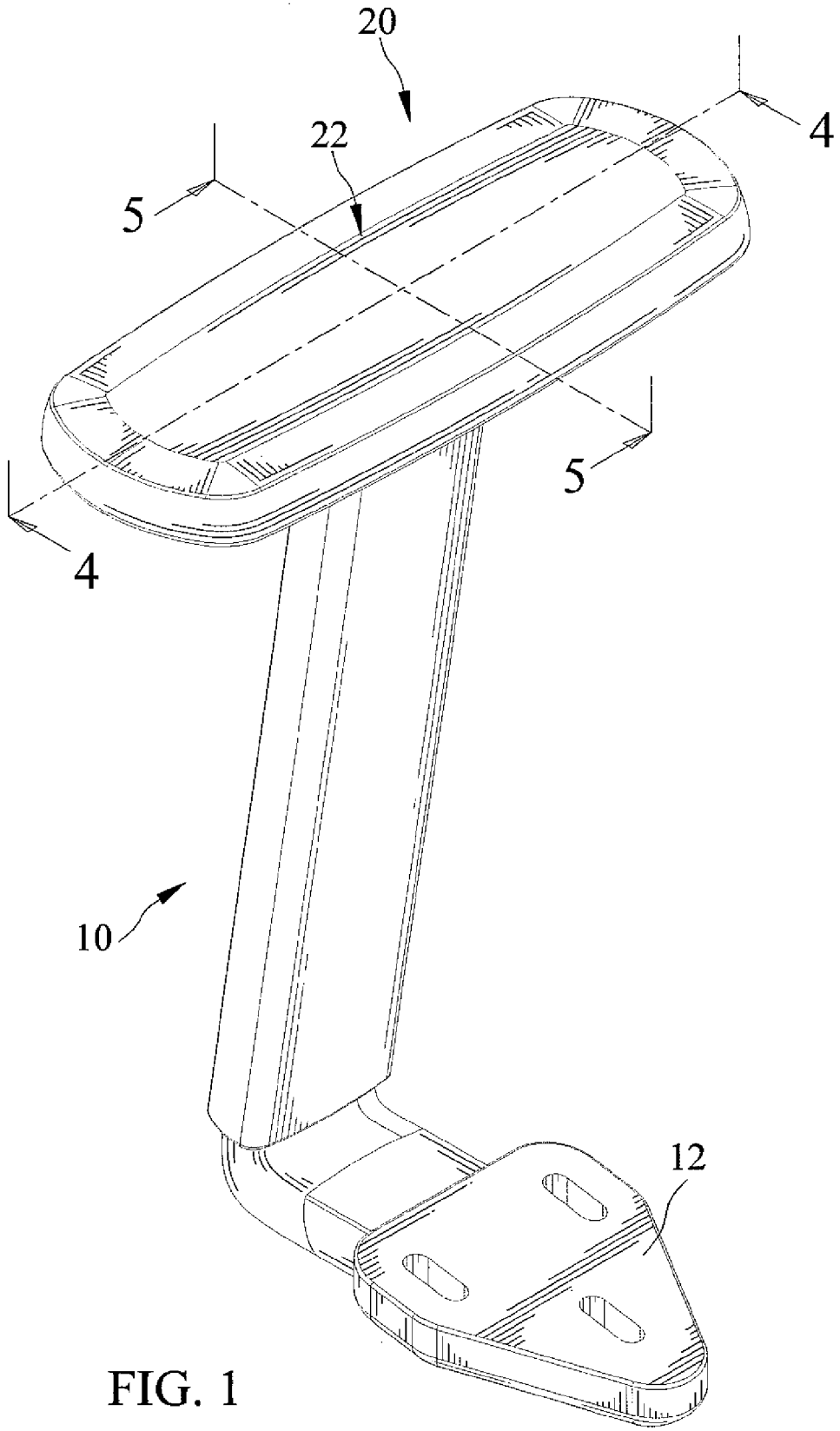
FIG. 1 shows a perspective view of an armrest assembly according to the present invention.

All figures are drawn for ease of explanation of the basic teachings only; the extensions of the figures with respect to number, position, relationship, and dimensions of the parts to form illustrative embodiment will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "end", "portion", "section", "lateral", "peripheral", "inward", and similar terms are used herein, it should be understood that these terms have reference only to the structure shown in the drawings as it would appear to a person viewing the drawings and are utilized only to facilitate describing the illustrative embodiment.

DETAILED DESCRIPTION OF THE PREFERRED EMBODIMENT

Figure 2:
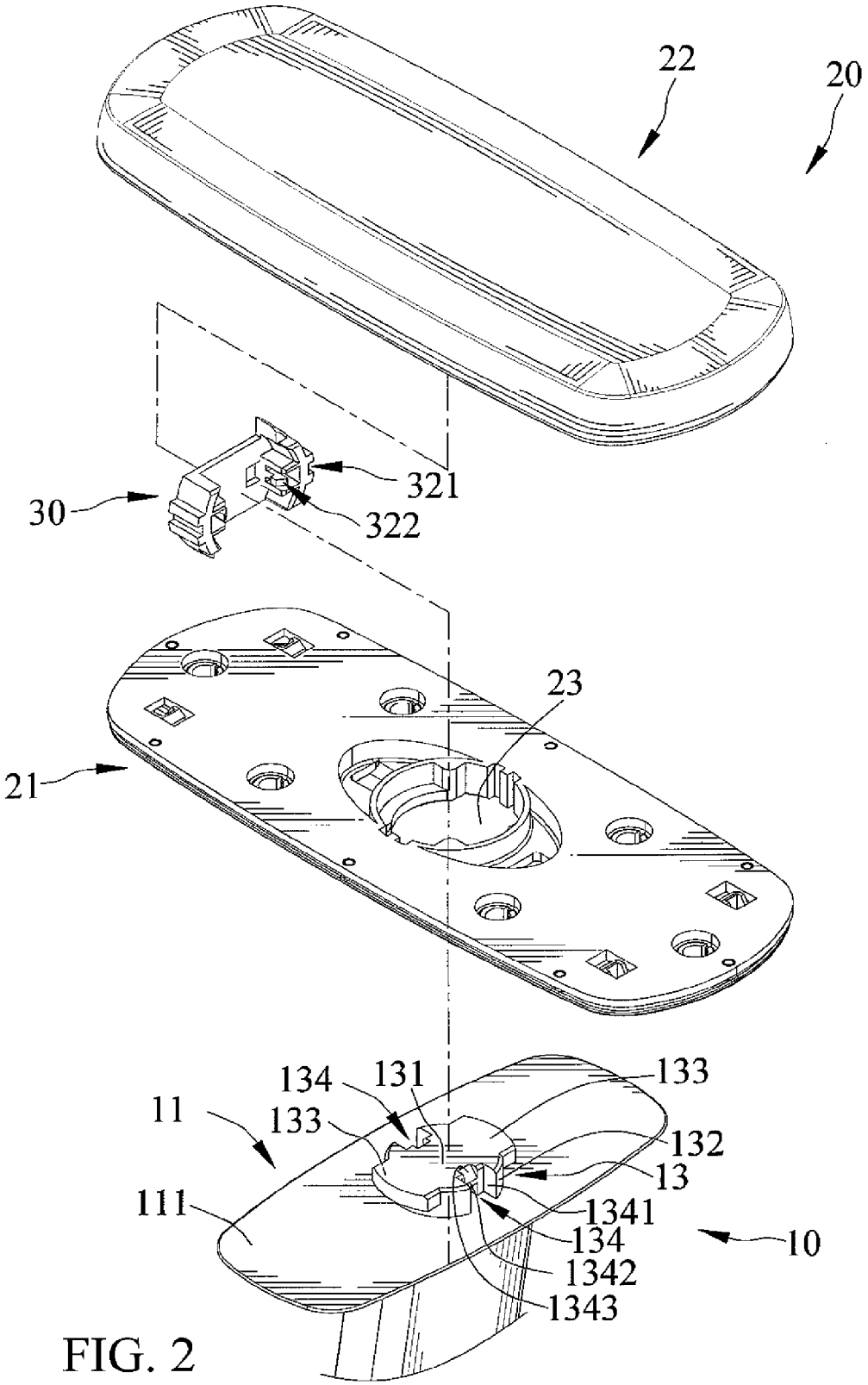
FIG. 2 shows a partial exploded perspective view of the armrest assembly of FIG. 1.
Figure 3:
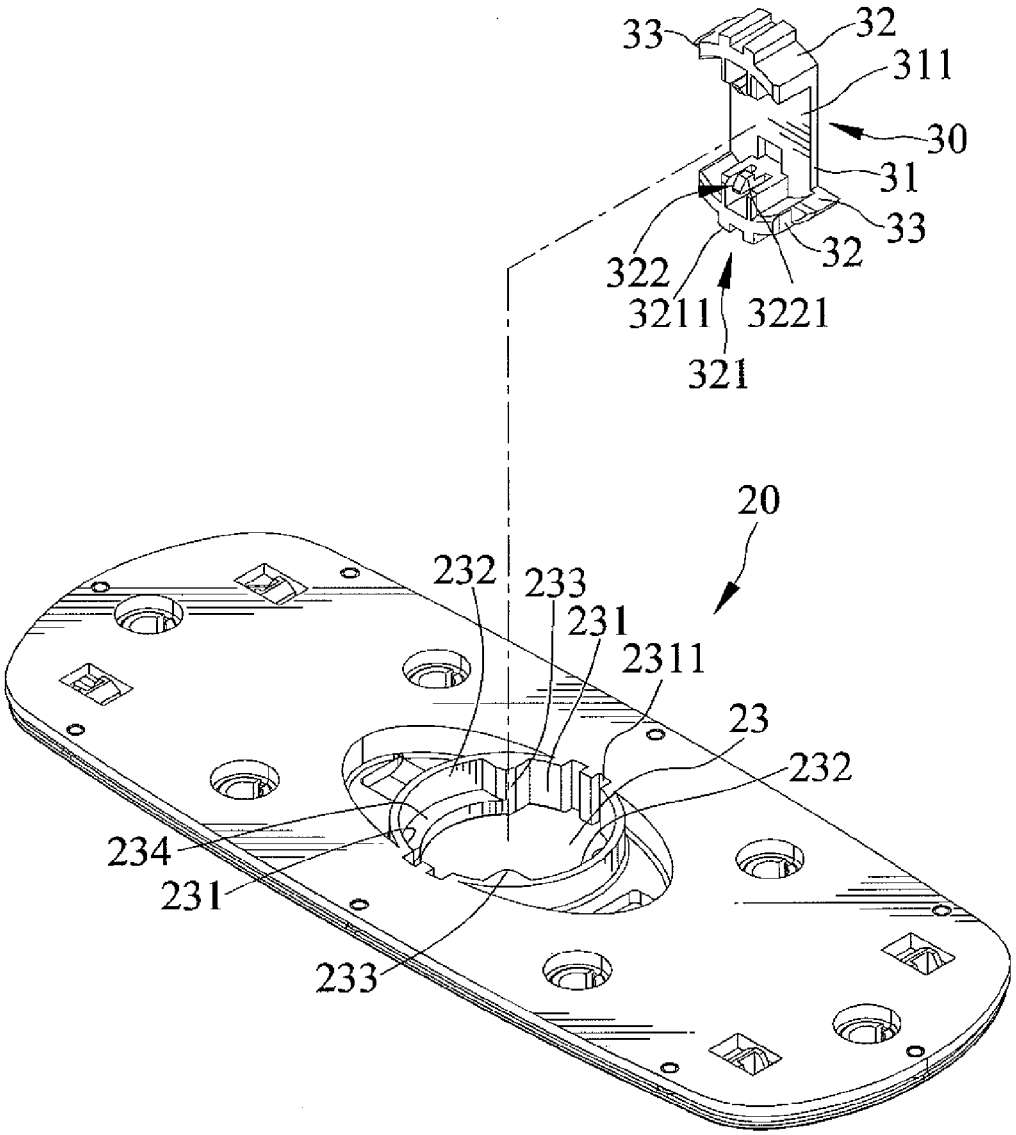
FIG. 3 shows a partial, enlarged view of the armrest assembly shown in FIG. 2.
Figure 4:
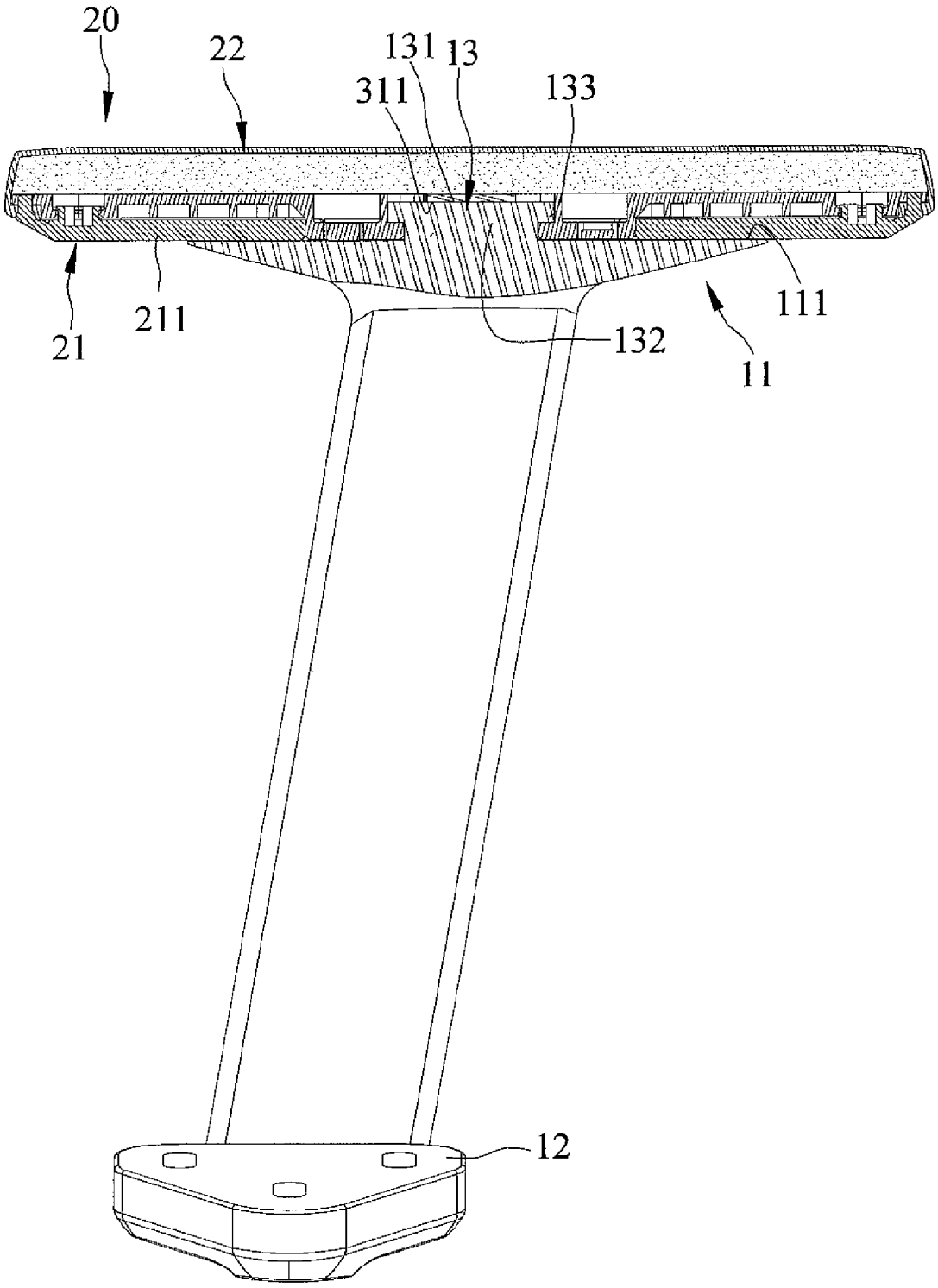
FIG. 4 is a cross sectional view taken along line 4-4 of the armrest assembly of FIG. 1.
Figure 5:
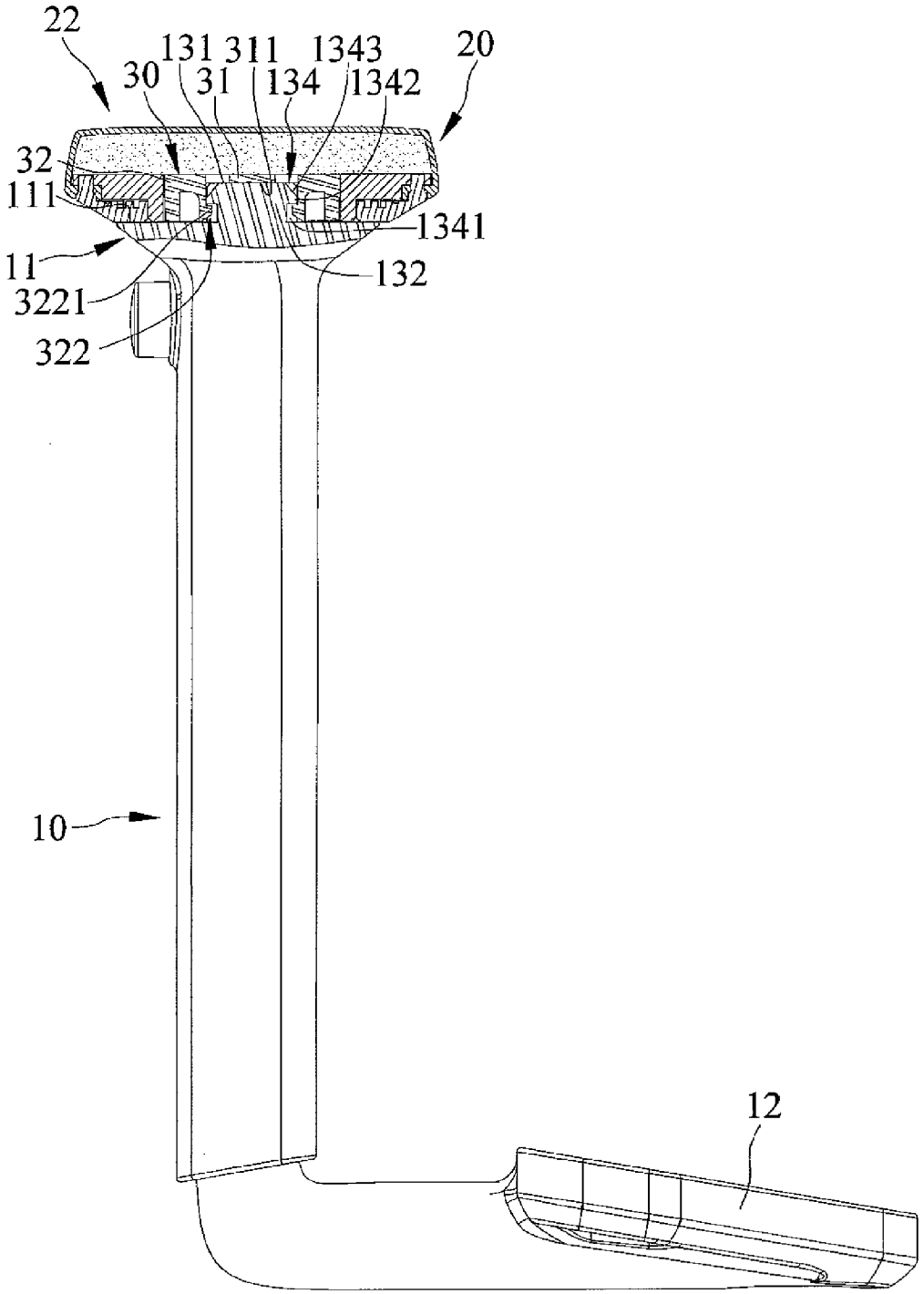
FIG. 5 is a cross sectional view taken along line 5-5 of the armrest assembly of FIG. 1.
Figure 6:
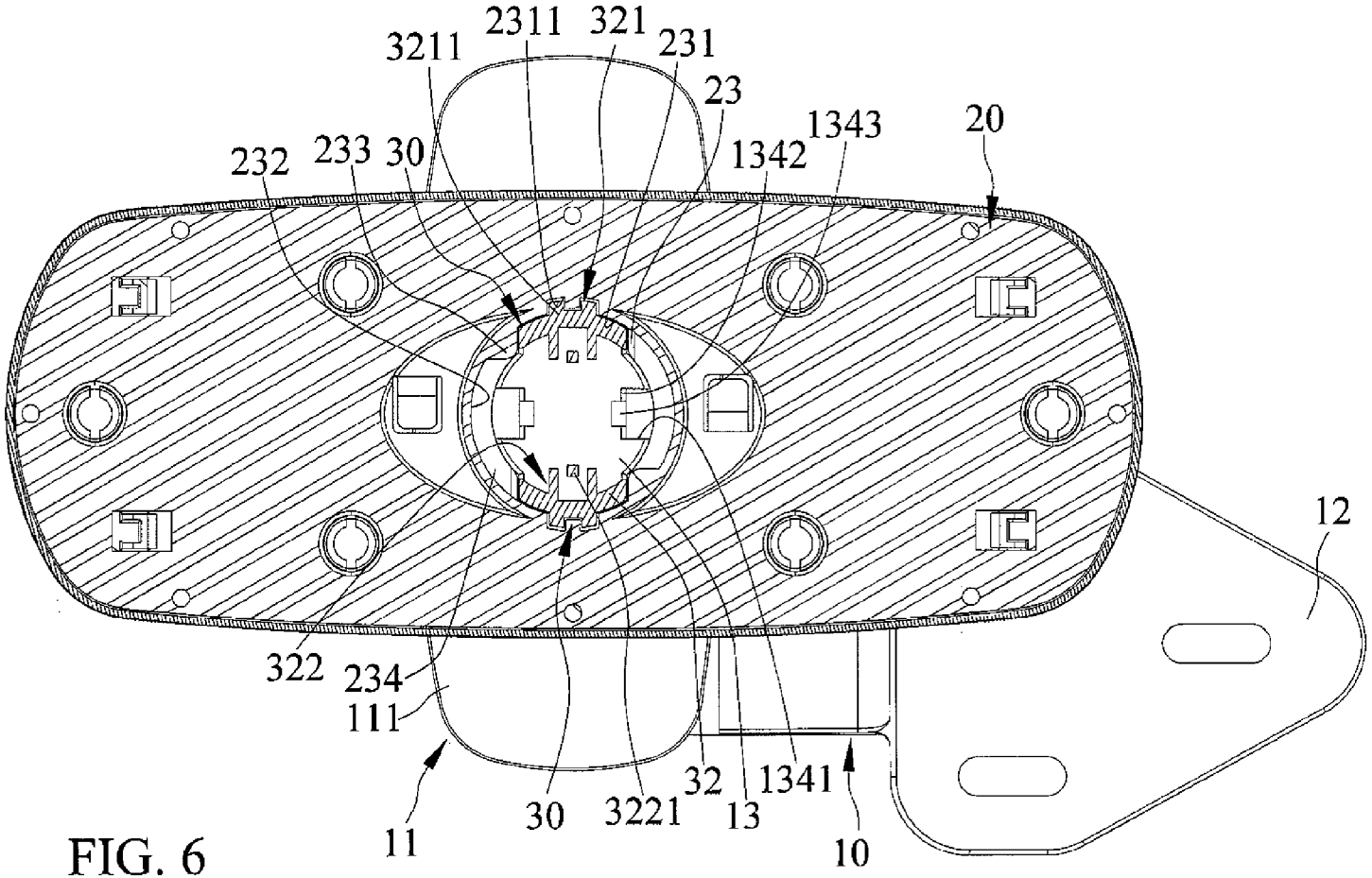
FIG. 6 shows a cross sectional view of the armrest assembly according to the present invention, and illustrates an arm support in an unlocking position.
Figure 7:
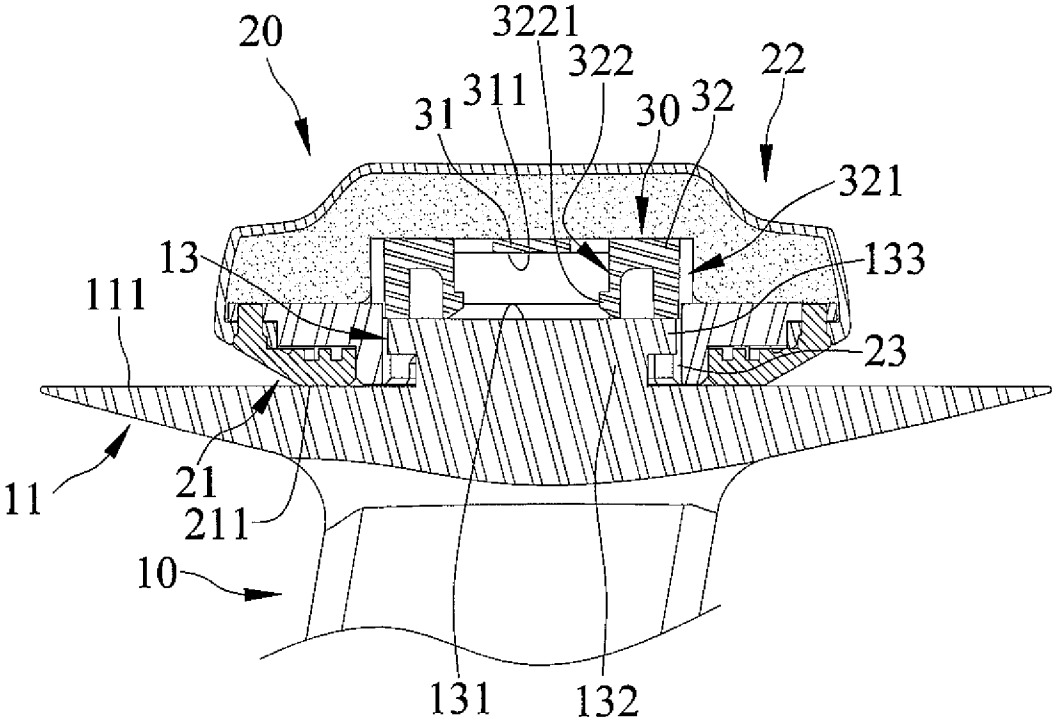
FIG. 7 shows a cross sectional view of the armrest assembly of FIG. 6, and illustrates two hooks of a connector abutting against an end face of an engaging member of a base.
Figure 8:
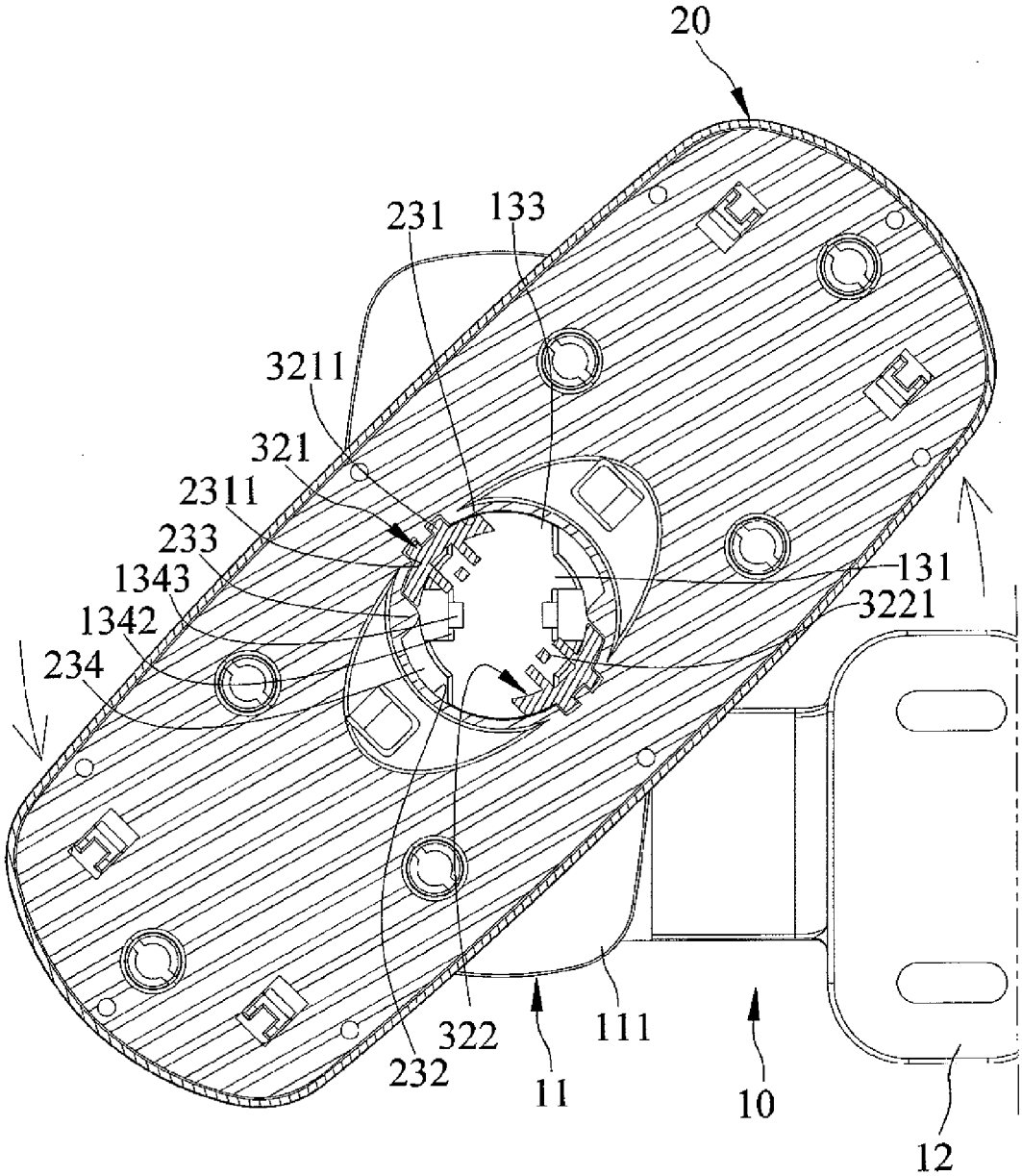
FIG. 8 shows a continued cross sectional view of the armrest assembly of FIG. 6, and illustrates the arm support pivoted in relation to the base.
Figure 11:
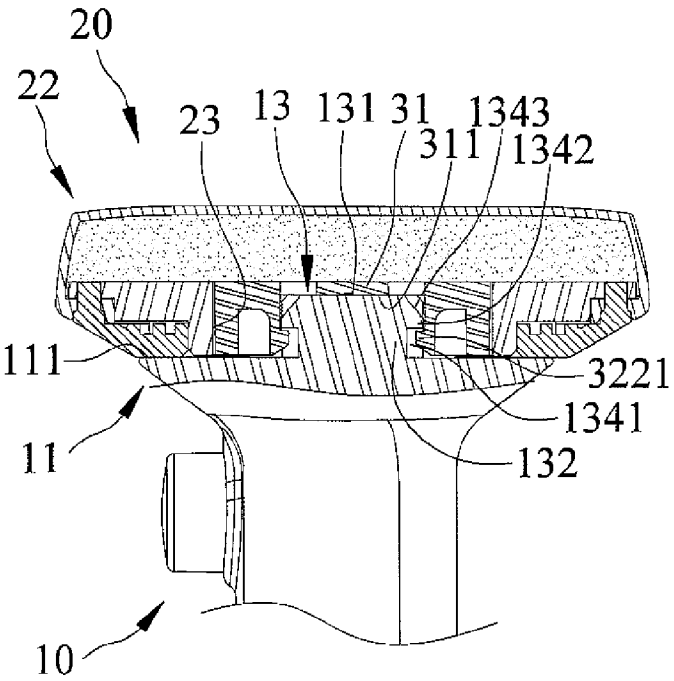
FIG. 11 shows a cross sectional view of the armrest assembly of FIG. 10, and illustrates the two hooks of the connector engaged with two protrusions of the engaging member.
Figure 9:
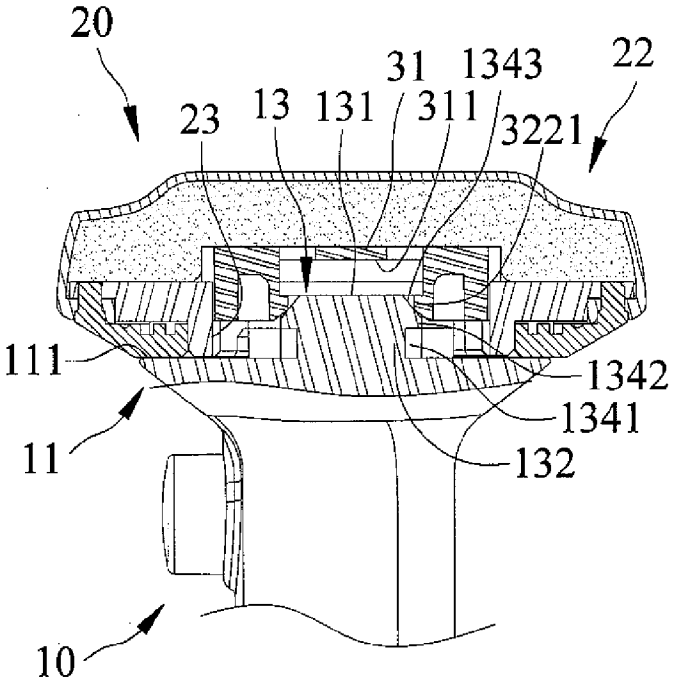
FIG. 9 shows a cross sectional view of the armrest assembly of FIG. 8, and illustrates the two hooks of the connector abutted against two inclined surface of the engaging member.
Figure 10:
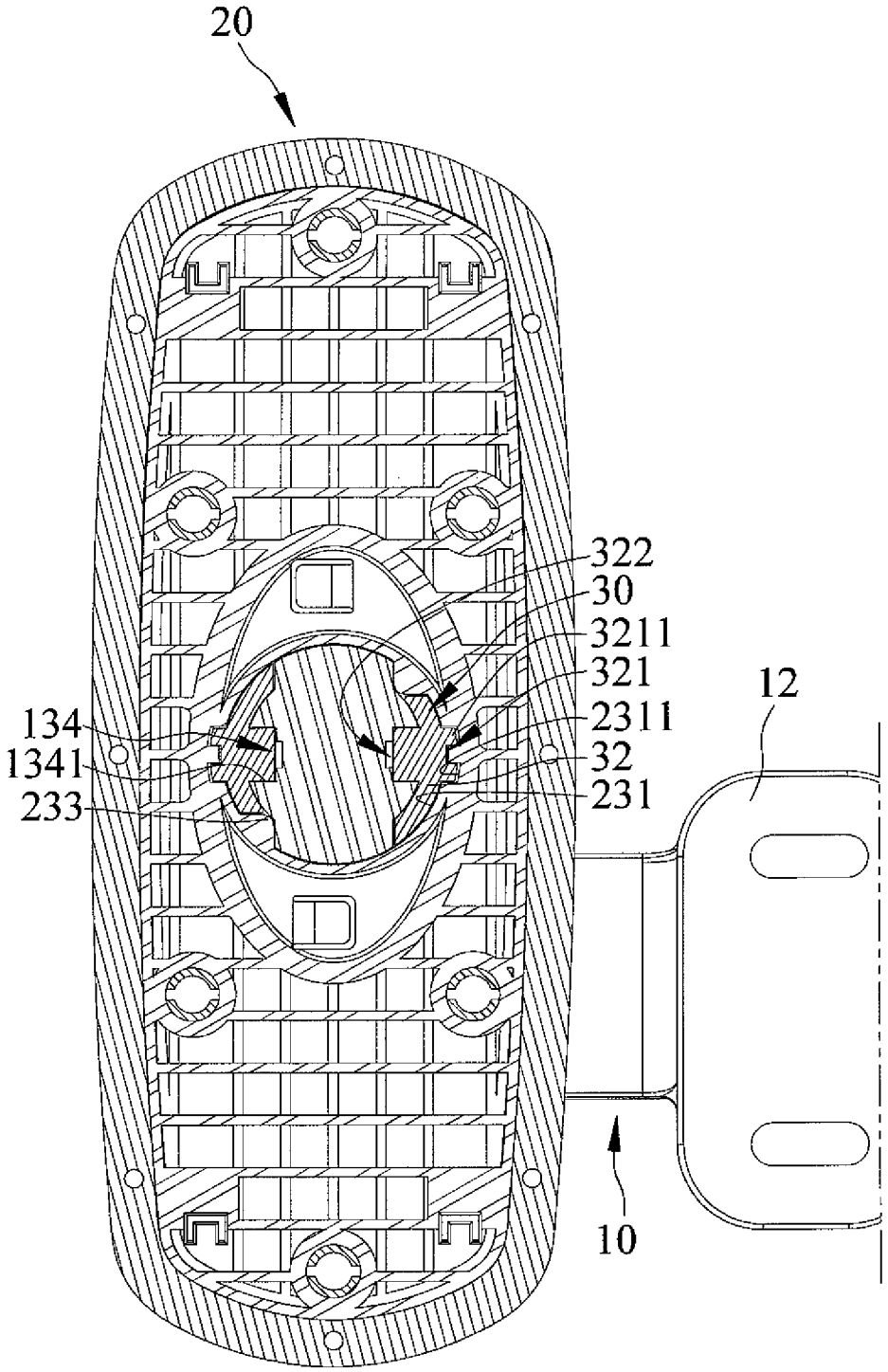
FIG. 10 shows a continued cross sectional view of the armrest assembly of FIG. 8, and illustrates the arm support in a locking position.

FIGS. 1 through 11 show an armrest assembly according to the present invention shown in the drawings. The armrest assembly includes a base 10, an arm support 20 connected with the base 10, and a connector 30 engaged between the base 10 and the arm support 20. The base 10 and the arm support 20 are manufactured separately.

The base 10 has a first connecting portion 11 and an installing portion 12 formed at two opposite ends thereof. The installing portion 12 is adapted for installing to a chair (not shown). A first surface 111 at one end of the first connecting portion 11 is opposite to the installing portion 12, and an engaging member 13 is formed thereon. The engaging member 13 longitudinally protrudes from the first surface 111. The engaging member 13 is generally T-shaped and has an end face 131 opposite to the first surface 111. In a preferred form, the end face 131 is extended parallel to the first surface 111. The engaging member 13 includes a body portion 132, two first engaging portions 133 radially extending oppositely from the body portion 132 to a radial extent, with the two first engaging portions 133 being spaced from but parallel to the first surface 111, and two second engaging portions 134 longitudinally extending at two arc sections of the body portion 132 between the two first engaging portions 133. In particular, each of the two second engaging portions 134 includes a recess 1341 longitudinally extending inward therefrom, a protrusion 1342 radially extending oppositely from a bottom face of the recess 1341 to a radial extent, and an inclined surface 1343 formed at the protrusion 1342 and connected with the end face 131.

The arm support 20 is adapted to assemble and pivotable in relation to the base 10. The arm support 20 includes a second connecting portion 21 and a supporting portion 22 formed at two opposite ends thereof. The second connecting portion 21 has first and second plates connected with each other. In particular, the supporting portion 22 is made of a soft material and adapted for resting a user's arm. A second surface 211 at one end of the second connecting portion 21 is opposite to the supporting portion 22 and abutable with the first surface 111 of the base 10. A cavity 23 is defined in the second surface 211 of the arm support 20 longitudinally and receives the engaging member 13. The cavity 23 includes two first receiving portions 231 having a shape corresponding to and for longitudinally slideably receiving the two first engaging portions 133 of the engaging member 13, and two second receiving portions 232 interconnected with the two first receiving portions 231 and having a shape corresponding to and for longitudinally slideably receiving the two arc sections of the body portion 132 and pivotally receiving the two first engaging portions 133 of the engaging member 13. Each of the two first receiving portions 231 includes a plurality of engaging slots 2311 radially extending outward therefrom. Moreover, the cavity 23 further includes two stopping portions 233 each radially extended inward between each of the two first receiving portions 231 and each of the two second receiving portions 232 adapted for abutting against the two first engaging portions 133 of the engaging member 13 to restrict the arm support 20 to pivot in relation to the base 10 in a single pivoting direction, and two restraining portions 234 formed in an arc shape and radially extending inward from distal ends of the two second receiving portions 232 adjacent to the second surface 211.

The connector 30 is longitudinally slideably received in the cavity 23 of the arm support 20 and engageable with the two second engaging portion 134 of the engaging member 13 of the base 10. The connector 30 includes a top portion 31 and two side portions 32 extending from two opposite distal ends of the top portion 31 and perpendicular to the top portion 31. The top portion 31 has an abutted face 311 abutted against the end face 131 of the engaging member 13. Each of the two side portions 32 has first and second coupled sections 321 and 322 formed opposite to each other. Each of the two first coupled sections 321 includes a plurality of lugs 3211 radially extending therefrom and engaged with the plurality of engaging slots 2311 of each of the two first receiving sections 231 of the cavity 23. Each of the two second coupled sections 322 includes a hook 3221 engageable with the protrusion 1342 of each of the two second engaging portions 134 of the engaging member 13. Moreover, the connector 30 further includes two flanges 33 extended outward from the two side portions 32 thereof and abutted against the two restraining portions 234 of the cavity 23 to prevent the connector 30 disengaged from the cavity 23 of the arm support 20.

The arm support 20 is pivotable in relation to the base 10 between an unlocked position and a locked position. When the arm support 20 is in the unlocked position, the two hooks 3221 of the two side portions 32 of the connector 30 abut against the end face 131 of the engaging member 13, with the two first engaging portions 133 engaged in the two first receiving sections 231 of the cavity 23 to cause the connector 30 longitudinally sliding with respect to the cavity 23 and pressing against the supporting portion 22 of the arm support 20. Thus, the supporting portion 22 is deformed.

With the engaging member 13 received in the cavity 23, the arm support 20 is pivoted 90 degrees counterclockwise about the base 10. Thus, the two first engaging portions 133 is engaged in the second receiving sections 232 of the cavity 23 and abutted against the two stopping portions 233 to cause the arm support 20 unable to be pivoted in relation to the base 10. Moreover, the two hooks 3221 of the two side portions 32 of the connector 30 are abutted against the two inclined surface 1343 of the two second engaging portions 134 of the engaging member 13.

Pressing the supporting portion 22 of the arm support 20 abuts against the connector 30 to cause the connector 30 longitudinally sliding with respect to the engaging member 13. The arm support 20 is in the locked position, the two second coupled sections 322 of the side portion 32 of the connector 30 are engaged with the two recesses 1341 of the two second engaging portions 134 of the engaging member 13, with the two hooks 3221 of the two side portions 32 of the connector 30 engaged with the two protrusions 1342 of the two second engaging portions 134 of the engaging member 13. Thus, the support 20 is unable to longitudinally move and pivot with respect to the base 10. The arm support 20 is securely fixed to the base 10.

The armrest includes the following advantages:

1. The base 10 and the arm support 20 are reliably assembled easily and quickly without use of complex machinery and without removing any fasteners.

2. The arm support 20 is pivotable in relation to the base 10 between an unlocked position and a locked position without fastening tools.

Now that the basic teachings of the armrest assembly have been explained, many extensions and variations will be obvious to one having ordinary skill in the art. For example, the base 10, the arm support 20, and the connector 30 can have shapes different from those shown in the figures.

Thus since the illustrative embodiment disclosed herein may be embodied in other specific forms without departing from the spirit or general characteristics thereof, some of which forms have been indicated, the embodiment described herein are to be considered in all respects illustrative and not restrictive. The scope is to be indicated by the appended claims, rather than by the foregoing description, and all changes which come within the meaning and range of equivalency of the claims are intended to be embraced therein.

What is claimed is:

1. An armrest assembly comprising:

a base including a connecting portion and an installing portion formed at two opposite ends thereof, with the installing portion adapted for installing to a chair, with a first surface at one end of the connecting portion opposite to the installing portion;

an arm support supported on the base, with the arm support including a second surface faced to the first surface of the base;

a cavity defined in one of the first and second surfaces;

an engaging member formed on the other of the first and second surfaces and pivotably received in the cavity between an unlocked position and a locked position; and a connector received in the cavity and engaged with the engaging member, with the arm support fixed to the base in the locked position; and wherein the engaging member includes an end face opposite the other of the first and second surfaces; and wherein the engaging member includes a body portion, two first engaging portions radially extending oppositely from the body portion, and two second engaging portions longitudinally extending at two arc sections of the body portion between the two first engaging portions and engageable with connector; and wherein the cavity includes two first receiving portions slideably receiving the two first engaging portions of the engaging member, and two second receiving portions slideably receiving the two arc sections of the body portion and pivotally receiving the two first engaging portions of the engaging member.

2. The armrest assembly as claimed in claim 1, wherein the connector is slideably received in the cavity and engageable with the two second engaging portion of the engaging member and includes a top portion and two side portions extending from two opposite distal ends of the top portion, with the top portion having an abutted face abutted against the end face of the engaging member, with each of the two side portions having first and second coupled sections formed opposite to each other.

3. The armrest assembly as claimed in claim 2, wherein each of the two first receiving portions includes a plurality of engaging slots, with each of the two first coupled sections including a plurality of lugs extending therefrom and engaged with the plurality of engaging slots of each of the two first receiving sections of the cavity.

4. The armrest assembly as claimed in claim 2, wherein each of the two second engaging portions includes a recess extending therefrom and engageable with each of the two side portions of the connector, a protrusion radially extending from a bottom face of the recess, with each of the two second coupled sections includes a hook engageable with the protrusion of each of the two second engaging portions of the engaging member.

5. The armrest assembly as claimed in claim 1, wherein the cavity includes two stopping portions each radially extended inward between each of the two first receiving portions and each of the two second receiving portions adapted for abutting against the two first engaging portions of the engaging member to restrict the arm support to pivot in relation to the base in a single pivoting direction.

6. The armrest assembly as claimed in claim 2, wherein the cavity includes two restraining portions radially extending inward from distal ends of the two second receiving portions, with the connector including two flanges extended outward from the two side portions thereof and abutted against the two restraining portions of the cavity to prevent the connector disengaged from the cavity.

7. The armrest assembly as claimed in claim 4, wherein an inclined surface is formed at the protrusion and connected with the end face, with two hooks of the two side portions of the connector abutable against the two inclined surface of the two second engaging portions of the engaging member.

8. The armrest assembly as claimed in claim 1, wherein the arm support includes a second connecting portion and a supporting portion formed at two opposite ends thereof, with the supporting portion being made of a soft material and adapted for resting a user's arm.

9. The armrest assembly as claimed in claim 1, wherein the cavity is formed in the second surface of the arm support.

10. The armrest assembly as claimed in claim 1, wherein the engaging member is formed on the first surface of the base, with the engaging member and base formed integrally as a single piece.

* * * * *